United States Patent [19]

Hepler, Jr.

[11] 4,247,086

[45] Jan. 27, 1981

[54] LANCE HOISTING AND SKULL DETECTING APPARATUS FOR BASIC OXYGEN STEELMAKING FURNACES

[75] Inventor: John G. Hepler, Jr., Upland, Calif.

[73] Assignee: Kaiser Steel Corporation, Oakland, Calif.

[21] Appl. No.: 5,198

[22] Filed: Jan. 22, 1979

[51] Int. Cl.[3] ..... C21C 5/32

[52] U.S. Cl. ..... 266/86; 266/226

[58] Field of Search ..... 266/99, 100, 225, 226, 266/86, 89; 177/147, 255; 294/85, 81 R

[56] References Cited

U.S. PATENT DOCUMENTS

| | | | |
|---|---|---|---|
| 1,217,334 | 2/1917 | Nelson | 177/263 |
| 3,386,722 | 6/1968 | Brooks et al. | 266/226 |
| 3,708,159 | 1/1973 | De Bray | 266/99 |
| 3,734,218 | 5/1973 | Krupper | 177/255 |

*Primary Examiner*—Michael L. Lewis

*Attorney, Agent, or Firm*—Naylor, Neal & Uilkema

[57] ABSTRACT

A pair of cables are employed to raise and lower the lance of a basic oxygen steelmaking furnace. A centrally suspended equalizer bar is connected between the cables and a load detector is connected to the bar to sense the weight of a lance being hoisted. The detector functions to sense the build up of a slag skull on the lance.

1 Claim, 3 Drawing Figures

LANCE HOISTING AND SKULL DETECTING APPARATUS FOR BASIC OXYGEN STEELMAKING FURNACES

BACKGROUND OF THE INVENTION

The present invention relates to a lance hoist for a basic oxygen steelmaking furnace and, more particularly, is directed to such a hoist wherein a detector is provided to sense the build up of a slag skull on the lance.

The build up of slag skulls on the lances of basic oxygen steelmaking furnaces is a common occurrence. It is troublesome because, if permitted to become excessive, it ultimately restricts passage of the lance through the lance port of the hood used with the furnace. In the prior art, the occurrence of such excessive build up was generally detected either visually, or as a result of impact of the skull against the hood. Prior art hoods typically employed doors on the lance port which could open to permit the passage of a lance skull through the port. Because of the extreme temperatures involved, recent visual detection techniques have employed television cameras. Once detected, the skulls have been removed by removing the lance from the furnace and breaking the skull away.

The problem of lance skull build up has become particularly acute with modern basic oxygen steelmaking furnaces because such furnaces employ extremely expensive hoods for pollution control purposes and the hoods are typically not provided with lance port doors to facilitate the passage of a large skull through the port. Such hoods make visual detection of the skull build up difficult and are likely to incur very costly damage if impacted by a lance skull.

In extreme cases, where lance skulls have impacted against the hoods of furnaces, lances have been totally lost and the lives of operating personnel have been lost. Additionally, when a skull builds up to the point where it impacts the hood of a furnace, the loss of large amounts of furnace operating time inevitably results.

Probably the most significant prior art to the present invention is U.S. Pat. No. 3,708,159. That patent discloses a lance hoist having a load cell and position transmitter incorporated thereinto to detect when the lance contacts the surface of the molten metal in a basic oxygen steelmaking furnace. The patent makes no suggestion, however, of detecting the build up of a lance skull and, apparently, is not concerned with that problem.

U.S. Pat. Nos. 1,507,598 and 4,032,020 are of interest in that they teach the employment of hoisting apparatuses wherein load detectors are employed in the apparatuses. The patents are not, however, concerned with the build up of lance skulls in basic oxygen steelmaking furnaces, or the problems associated with such build up.

SUMMARY OF THE INVENTION

The present invention detects lance skull build up by sensing weight build up of the lance through a load detector incorporated into the lance hoisting apparatus. The detector may take the form of a load cell which functions to continuously monitor the weight of the lance and/or a load switch which functions to deactivate the hoisting structure and trigger an alarm upon the sensing of a predetermined weight.

In a preferred embodiment, the lance hoist employs a pair of lifting cables connected together at one end through an equalizer bar. The detector is connected between the center of the bar in a pivotal suspension for the bar. This embodiment has the advantage that the detector is not subject to off-axial loading and does not move up and down with operation of the hoisting structure.

A principal object of the present invention is to provide a means for automatically and reliably sensing the build up of a slag skull on the lance of a basic oxygen steel-making furnace.

Another object of the invention is to provide a lance skull detector which is incorporated into the hoisting apparatus for the lance and is so situated as to provide a reliable reading and to be isolated from damage.

Still another and more specific object is to provide a lance skull detector employing a load cell and/or load responsive switch which is not subjected to off-axial loading.

A further specific object of the invention is to provide a lance hoisting apparatus employing a pair of lifting cables wherein the cables are connected by an equalizer bar and the bar is pivotally suspended through means of a load detector disposed centrally of the length of the bar.

The foregoing and other objects will become more apparent when viewed in light of the following detailed description and the accompanying drawings.

DESCRIPTION OF THE ILLUSTRATED EMBODIMENTS

Figure 1:
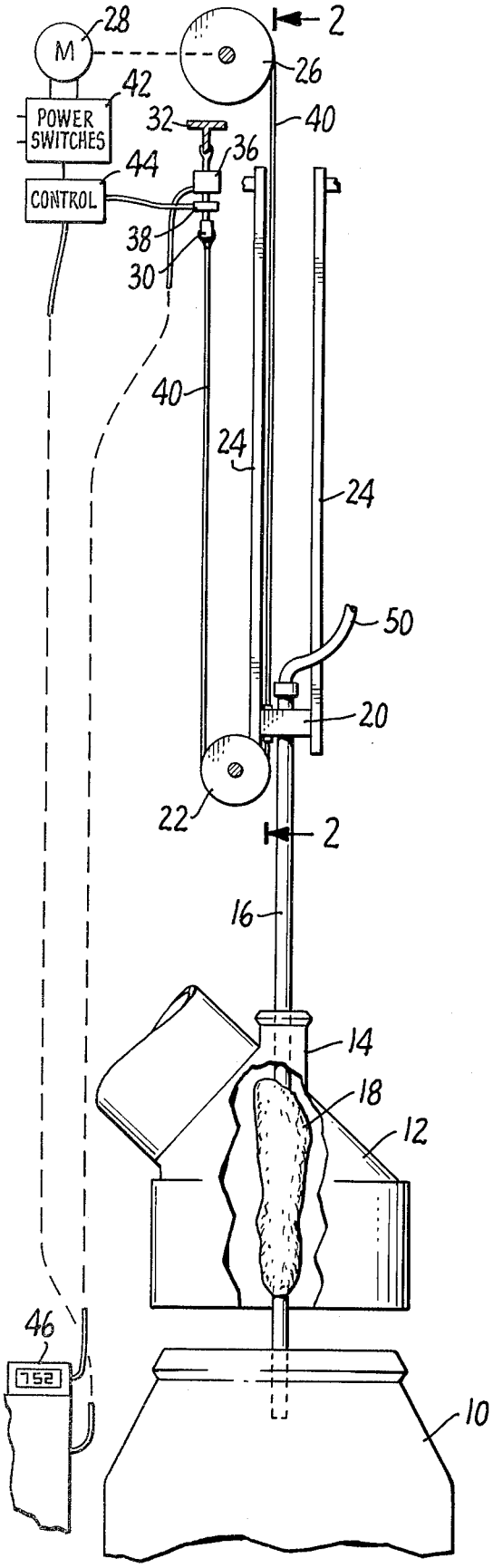
FIG. 1 is an elevational view, with parts shown diagrammatically and parts broken away, illustrating a basic oxygen steelmaking furnace employing the preferred embodiment of the apparatus of the present invention.

Referring now to FIG. 1, the basic oxygen furnace therein is designated by the numeral 10 and shown as having a hood 12 disposed thereover. The hood 12 is formed with a lance port 14 and the lance 16 extends slidably through the port for movement into and out of the furnace. For purposes of illustration, the lance is shown as having a slag skull 18 built up thereon. As shown, the skull is of a size greater than that of the port 14 and, thus, would impact against the hood 12 if the lance were hoisted.

Figure 2:
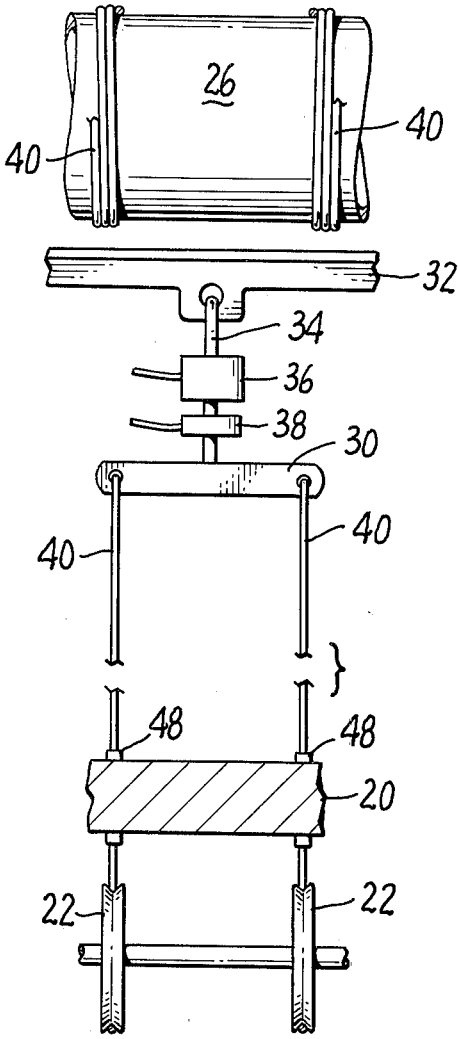
FIG. 2 is an elevational cross-sectional view taken on the plane designated by line 2—2 of FIG. 1, illustrating the load detector mounting arrangement of the preferred embodiment.

The lance hoisting apparatus comprises: a carriage 20 having the upper end of the lance 16 secured thereto; a pair of pulleys 22 (see FIG. 2) rotatably mounted on the carriage; a pair of tracks 24 engaged by the carriage to guide the carriage in a vertical rectilinear path; a hoisting drum 26 driven by a reversible electric motor 28, an equalizer bar 30 centrally suspended from a fixed mounting bracket 32 by a link 34 having a load cell 36 and a load switch 38 incorporated thereinto; a pair of hoisting cables 40 extending around the pulleys 22 and having first ends secured to opposite ends of the equalizer bar 30 and second ends secured to the hoisting drum 26; power switches 42 connected to the motor 28 to selectively energize the motor; an overriding control 44 connected between the load switch 38 and the control switches 42 to deenergize the motor 28 in the event of the sensing of an overloaded condition of the lance by the switch 38; and a digital readout 46 located at a remote operating station and connected to the load cell 36.

The cables 40 pass through guide sleeves 48 in the carriage 20. An oxygen supply hose 50 is connected to the upper end of the lance 16. Load cell 36 and load switch 38 may take any suitable commercially available form. One such form of switch has been found to be the Dillon Tensile Load Switch Type FCS-T-15 with a 25,000 lb. rating. The load cell may be a conventional electronic crane scale designed for high temperature heavy industrial use.

In operation, the lance hoisting apparatus operates generally in a conventional manner. As viewed in FIG. 1, driving the drum in a clockwise direction functions to lower the lance, and driving the drum in a counterclockwise direction functions to raise the lance. The equalizer bar maintains equal tension on the cables 40. The load on the cables is carried by the link 34 and imparted to the cell 36 and switch 38 in an axial direction, without off-axial loading. The weight of the lance is constantly monitored by the cell 36 and may be read on the digital readout 46. In the event of loading of the lance beyond the predetermined limit, the load switch 38 triggers the control 44 to deactivate the motor 28. The latter control may also energize a suitable alarm.

Figure 3:
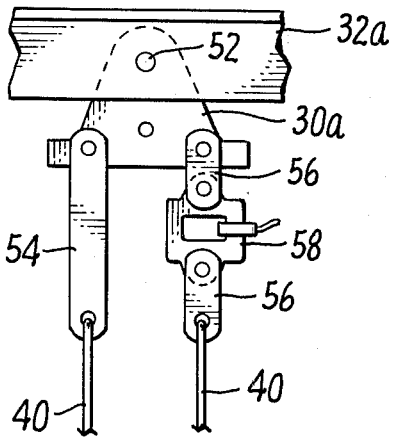
FIG. 3 is an elevational view, somewhat similar to FIG. 2, illustrating an alternative embodiment of the load detector mounting arrangement.

FIG. 3 shows an alternate arrangement for connecting the cables 40 to a mounting bracket, designated 32*a*. In this arrangement, the equalizer bar, designated 30*a*, is pivotally connected to bracket 32*a* by a pin 52. The pin defines an axis located centrally of the connecting points for the cables 40. One of the cables 40 is connected to the bar 30*a* by a link 54 and the other of the cables 40 is connected to the bar 38*a* by a pair of links 56 having a load switch 58 connected therebetween. The load switch 58 corresponds to the switch 38 in structure and mode of operation.

In operation, the embodiment of FIG. 3 operates identically to that of FIG. 1, with the exception that it does not incorporate a load cell and associated digital readout. Another obvious difference is that the load switch 58 is connected between the load bar 30*a* and one of the cables 40 rather than between the load bar and the mounting bracket therefor. The latter difference does not alter the operation of the switch, other than to reduce the load imparted thereto by one-half. Pivotal connections between the links 56 and the switch 58 assure that the switch is loaded without off-axial loading.

Conclusion

From the foregoing detailed description, it is believed apparent that the present invention enables the attainment of the objects initially set forth herein. It should be understood, however, that the invention is not intended to be limited to the specifics of the illustrated embodiments, but rather is defined by the accompanying claims.

What is claimed is:

1. In a basic oxygen steelmaking furnace having a hood with a lance port therein, a lance extending through the port for movement relative to the hood and furnace, and a lance carriage secured to the lance, the improvement comprising: a hoisting drum; an equalizer bar centrally suspended on a pivot; a pair of hoisting cables extending around pulleys on the carriage, said cables having first ends secured to opposite ends of the equalizer bar and second ends secured to the hoisting drum whereby reeling the cables on and off of the drum functions to raise and lower the carriage and the equalizer bar functions to maintain equal tension in the cables; a load detector connected between the equalizer bar and the first end of one of the cables to sense the weight of slag skull buildup on the lance; drive means to reel the cables on and off of the drum; and hoisting drum control means connected between the drive means and the load detector to interrupt the lifting operation of the drive means in the event the detector senses that the weight of slag skull buildup on the lance is of a magnitude which indicates that the skull cannot pass through the lance port.

* * * * *